United States Patent [19]

Uematsu et al.

[11] Patent Number: 4,635,661

[45] Date of Patent: Jan. 13, 1987

[54] AUTOMATIC COIN DEPOSITING AND PAYING MACHINE

[75] Inventors: Yoshiaki Uematsu, Numazu; Hideshi Sentoku, Tokyo, both of Japan

[73] Assignee: Laurel Bank Machine Co., Ltd., Tokyo, Japan

[21] Appl. No.: 688,546

[22] Filed: Jan. 3, 1985

Related U.S. Application Data

[63] Continuation-in-part of Ser. No. 510,587, Jul. 5, 1983, abandoned.

[30] Foreign Application Priority Data

Jul. 9, 1982 [JP] Japan ..... 57-119243

[51] Int. Cl.[4] ..... G07D 3/00

[52] U.S. Cl. ..... 133/3 R; 133/3 F; 133/5 R; 194/302

[58] Field of Search ..... 133/3 F, 3 R, 3 C, 3 D, 133/3 H, 8 R, 8 D, 8 E, 2, 4 R; 194/100 A, 1 C, 1 D, 10, DIG. 26, 302

[56] References Cited

U.S. PATENT DOCUMENTS

| | | | |
|---|---|---|---|
| 4,286,703 | 9/1981 | Schuller et al. | 194/100 A |
| 4,340,150 | 7/1982 | Guibord et al. | 194/DIG. 26 X |
| 4,361,162 | 11/1982 | Brisebarre | 133/8 E X |
| 4,365,700 | 12/1982 | Arimoto et al. | 133/3 R X |
| 4,558,711 | 12/1985 | Yoshiaki et al. | 133/3 F |
| 4,558,712 | 12/1985 | Sentoku et al. | 133/3 R |

*Primary Examiner*—Joseph J. Rolla
*Assistant Examiner*—Jay I. Alexander
*Attorney, Agent, or Firm*—Fleit, Jacobson, Cohn & Price

[57] ABSTRACT

The automatic coin depositing and paying machine has a function of depositing coins and another function of paying out a portion of the deposited coins. The deposited coins are discriminated by one discriminator into acceptable ones and unacceptable ones. The accepted coins are stored in coin storing tubes in accordance with their kinds which are discriminated by another discriminator. Some of coins stored in coin storing tubes are used as paying money. The unaccepted coins are returned to the customer through the exit. The recovery hole is provided to be opened and closed by a recovery cover for providing communication between the safe and the exit.

5 Claims, 10 Drawing Figures

AUTOMATIC COIN DEPOSITING AND PAYING MACHINE

CROSS-REFERENCE TO OTHER APPLICATION

This application is a continuation-in-part of copending application Ser. No. 510,587, filed July 5, 1983, now abandoned.

BACKGROUND OF THE INVENTION

1. Field of the Invention

The present invention relates to an automatic coin depositing and paying machine which is made operative to select and temporarily store coins received and to reuse the selected and stored coins as payable ones.

2. Description of the Prior Art

In the prior art, there have been used a number of coin counting machines which have a function to automatically discriminate the kinds of coins received thereby to receive and count genuine ones. There have also been used a number of coin paying machines which have a function to store genuine coins in coin storing tubes thereby to pay them off one by one from the lower portions of those coin storing tubes.

However, the machines of these two kinds are not considered in respect of enhancing the cycling efficiency of the coins, although they have independent functions as special machines. This lack of consideration will be supplementarily explained. In a banking system, for example, in case where money is paid and received across the counter between the clerk and the customer with coins being included in the dealings, the coins are repeatedly used either as change or for adjustment of fractions so that their cycling efficiency is enhanced to a remarkably high level.

In case where the dealings are conducted with such a high coin cycling efficiency, even if the aforementioned coin counting and paying machines are independently arranged, there arise defects that it becomes frequently necessary to manually transfer the coins between the two machines, that the coins are required in such surplus that the coins are respectively stored in the two machines, and that the spaces required for installing the two machines becomes large.

SUMMARY OF THE INVENTION

The present invention has been conceived in view of the background thus far described and has as its objects: to provide an automatic coin depositing and paying machine which is enabled to automatically conduct a series of operations to select coins received thereby to return improper ones, to temporarily store the improper coins in coin storing tubes in accordance with the kinds thereof, and to pay off and out the stored coins one by one in response to necessity, whereby it can enhance the cycling efficiency of the coins so that it is suitable as the window machine or a banking system or the like; and to automatically recover the coins in the coin storing tubes to a safe at the end of dealings or the like.

According to a feature of the present invention, there is provided an automatic coin depositing and paying machine comprising: a discriminator for discriminating the kinds and so on of coins inserted; a plurality of coin storing tubes for respectively receiving and storing the coins, which have their kinds discriminated by said discriminator, in accordance with the discriminated kinds; a pay-off mechanism for paying off the coins one by one from the lower portions of said coin storing tubes; a lift belt for receiving the coins paid off from said pay-off mechanism and conveying the same to the exit of said machine; a safe for receiving the coins to be stored when at least one of said coin storing tubes is fully occupied; and a recovery hole adapted to be opened and closed by a recovery cover for providing communication between said safe and said exit.

BRIEF DESCRIPTION OF THE DRAWINGS

Other objects, features and advantages of the present invention will become apparent from the following description taken with reference to the accompanying drawings in which.

DESCRIPTION OF THE PREFERRED EMBODIMENT

The present invention will be described in the following in connection with an embodiment thereof with reference to the accompanying drawings.

Figure 1:
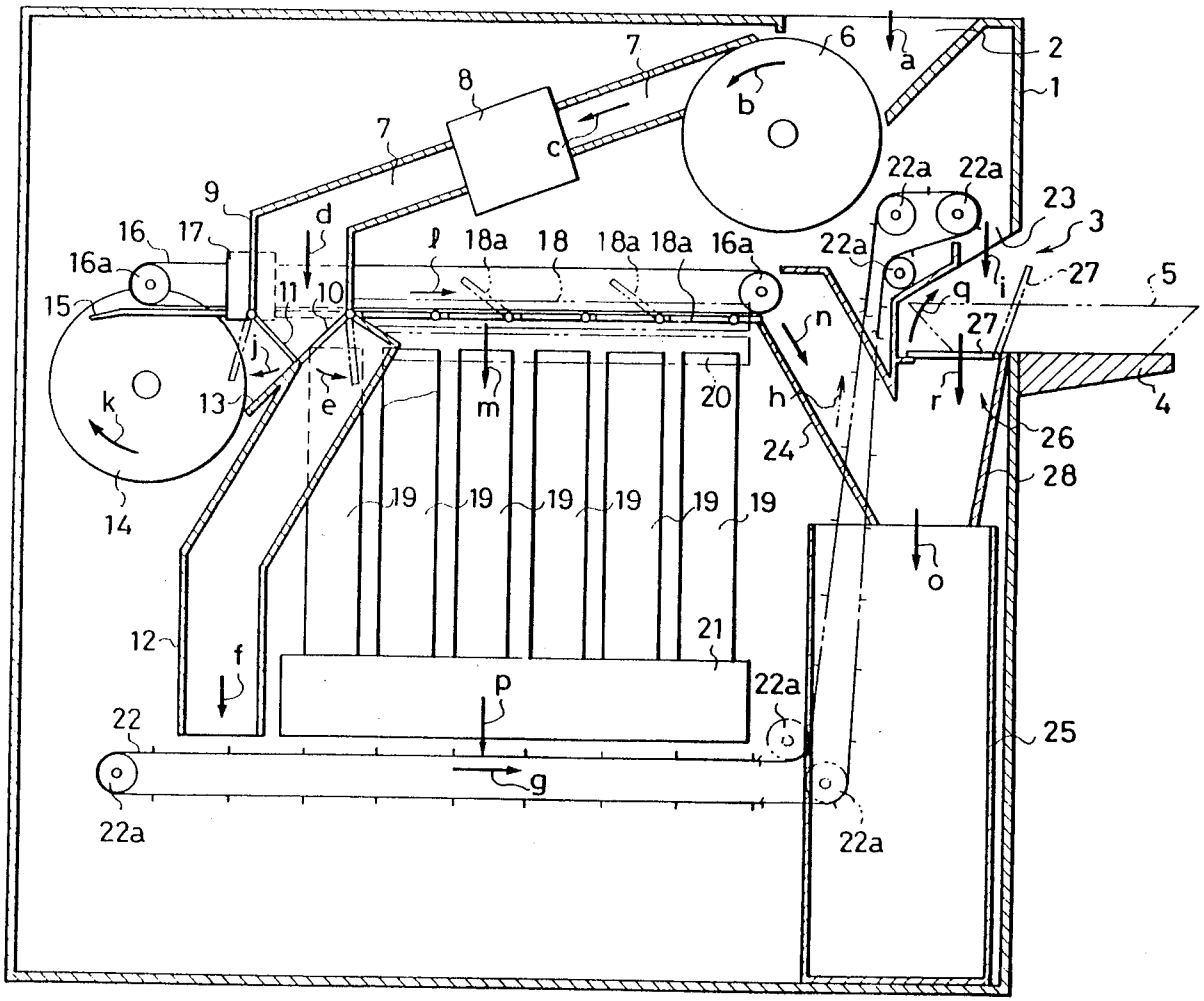
FIG. 1 is a side view schematically showing an automatic coin depositing and paying machine according to the present invention.

FIG. 1 is a schematic diagram of the present invention illustrating its mechanism.

The reference numeral in FIG. 1 indicates a machine body. This machine body 1 is formed at its upper portion with an opening 2 for receiving coins therethrough and at its front side with an exit 3 for paying and returning coins therethrough. The machine body 1 is equipped below the exit 3 with a shelf 4 on which there is placed a carton 5 for receiving the coins to be paid.

In the machine body 1 thus constructed, moreover, there is disposed a rotary disc 6 which is made operative partly to receive the coins inserted into the aforementioned opening 2 and partly to scoop up the coins by means of its pockets and pins thereby to separately lift off the scooped coins one by one. A received coin transfer passage 7 is disposed to run below that rotary disc 6 such that it is opened toward the coin exit of the rotary disc 6.

Midway of that coin passage 7, there is arranged a first discriminator 8 for discriminating the kinds of the coins. This first discriminator 8 has functions of discriminating the kinds of coins by detecting the external diameters and materials of the coins so that the kinds and genuinenesses of the coins are determined in dependence upon whether or not the discriminated results of the two functions are coincident.

Into the leading end of the received coin transfer passage 7, moreover, there is provided a vertical cylinder 9 for guiding the discriminated coins downward. This vertical cylinder 9 is equipped with first and second shutters 10 and 11 which are hinged thereto in an abutting state for switching the dropping directions of the coins.

Each of these first and second shutters is operably driven by a solenoid via a link or the like (although neither are shown).

Below the first shutter 10, there is disposed a first chute 12 for allowing the coins which have been judged as improper ones by the first discriminator 8 to drop down. Below the second shutter 11, there is disposed a slip slope 13 for guiding the coins which have been judged as proper ones by the first discriminator 8.

In front of the aforementioned slip slope 13, there is disposed another rotary disc 14 for scooping up the coins one by one to separately feed the same. From the coin exit of the rotary disc 14, there extends a horizontal transfer passage, which is constructed for a guide 15 and a horizontal conveyor belt 16 trained on respective rollers 16a, 16a and so on, so that the coins are conveyed in a horizontal direction, while being clamped separately one by one by pins anchored to the horizontal conveyor belt 16.

Partway (e.g., in the vicinity of the inlet) of the transfer passage constructed of the guide and horizontal conveyor belt 15 and 16, there is disposed a second discriminator 17 for discriminating the kinds of coins in terms of the external diameters of the coins. On the aforementioned transfer passage downstream of that second discriminator 17, there is disposed a gate mechanism 18 which switches its gates 18*a* for the respective kinds of coins by the action of solenoids in synchronism with the horizontal conveyor belt 16 in accordance with the discriminated results of the second discriminator 17 thereby to allow the coins to drop through the holes or the like formed in the aforementioned guide 15.

Below the gate mechanism 18, moreover, there are disposed respective coin storing tubes 19 for receiving and piling the coins which have been appropriately guided for their respective kinds by the gates 18*a*. To the upper portions of the coin storing tubes 19, there is attached an overflow detector 20 which makes use of a photosensor or the like for detecting that the coin storing tubes 19 are filled up with the coins. To the lower portions of the coin storing tubes 19, on the other hand, there is attached a pay-off mechanism 21 for paying off and allowing the lowermost coins to drop down one by one out of the tubes 19.

Below the aforementioned first chute 12 and the pay-off mechanism 21, furthermore, there extends a lift belt 22 which is trained on respective rollers 22*a*, 22*a* and so on thereby to convey the coins having dropped to the vicinity of the front exit 3 of the machine body 1. In the vicinity of a position in which the upper portions of the belt is turned down, there is formed a drop hole 23 which leads to the aforementioned exit 3.

At the front end portions (which are located such as to protrude from the gate mechanism 18 in the transfer direction) of the aforementioned guide and horizontal conveyor belt 15 and 16, there is disposed a second chute 24 for collecting the coins which are not stored in the respective coin storing tubes 19. A safe 25 for storing coins is so fitted in the machine body 1 below the second chute 24 that it can be drawn out of the machine body 1.

Below the bottom portion of the aforementioned exit 3, moreover, there is disposed a recovery hole 26 for providing communication between the exit 3 and the upper portion of the aforementioned safe 25. This recovery hole 26 is opened in case of necessity for adjustment or the like by virtue of the fact that its recovery cover 27 is actuated by means of a motor or solenoid. Below the recovery hole 26, there is disposed a recovery chute 28 which is adapted to have communication with the aforementioned second chute 24 thereby to allow the coins to drop into the safe 25.

Next, description will be made of the automatic coin depositing and paying machine having the construction thus far described, with reference to detailed sectional views thereof.

Figure 2:
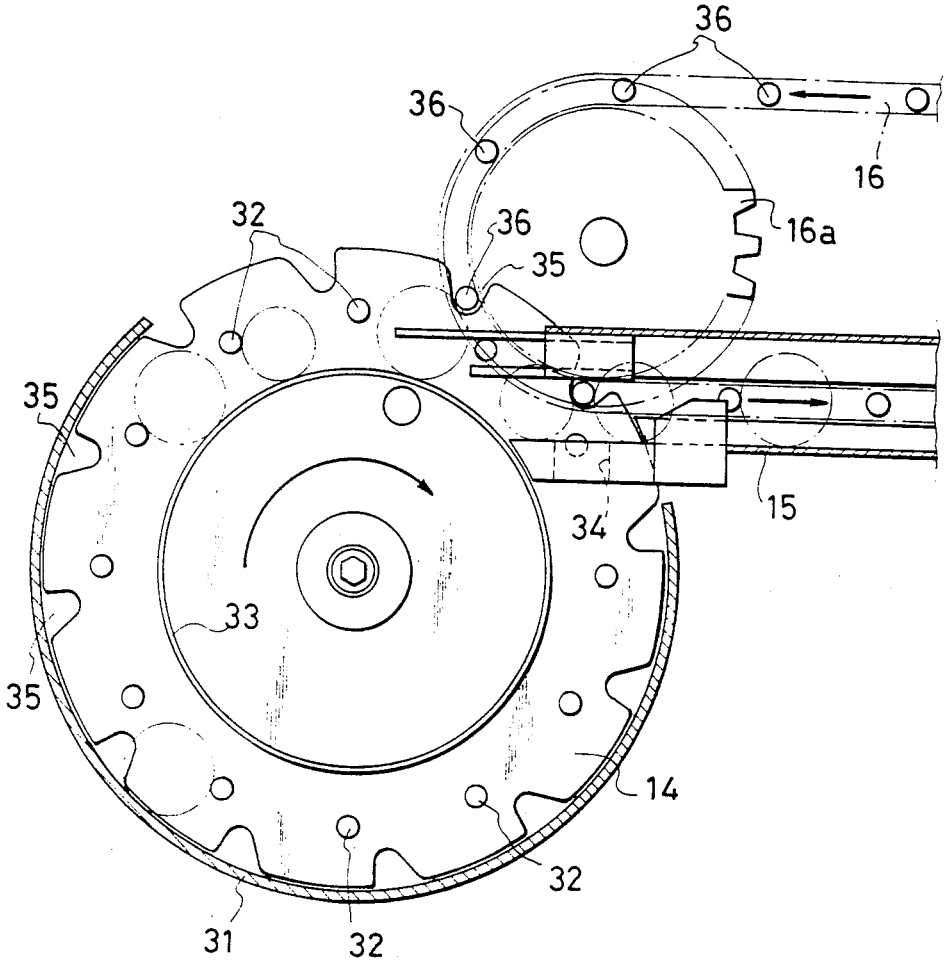
FIG. 2 is a side view showing a delivery mechanism for use in the machine.

FIG. 2 shows a drawing of a delivery mechanism for delivering coins from the aforementioned rotary disc 14 to the horizontal conveyor belt 16.

In the drawing, as in the case of a conventional apparatus, a hopper 31 is provided around the periphery of the rotary disc 14 with a very small distance therebetween.

Moreover, pins 32, 32 and so on are provided equidistantly and substantially on the periphery of the upper surface of the rotary disc 14, and a concentrically-shaped step portion 33 is formed practically in the center of the upper surface of the rotary disc 14. Furthermore, substantially triangularly-shaped notches 35, 35 and so on are formed on the periphery of the rotary disc 14 in correspondence with the pins 32, 32 and so on.

Meanwhile, on the upper surface of the upper portion of this rotary disc 14, one end of the guide 15 is provided in such a manner as to face the step portion 33 on the rotary disc 14, and on this guide 15 is formed an escape groove 34 for allowing the pins 32, 32 and so on provided on the rotary disc 14 to escape (move freely).

On the other hand, above this rotary disc 14, a horizontal transfer passage is formed along the guide 15, as mentioned above.

In this horizontal transfer passage, there is provided a horizontal conveyor belt (or a similar chain) 16 trained on rollers (to be more specific, chain sprockets) 16a and 16a provided at a horizontal position along the guide 15. At the same time, on this horizontal transfer belt 16, a multiplicity of pins 36, 36 and so on, which engage with the notches 35, 35 and so on in synchronism with the rotation of the rotary disc 14, are provided equidistantly on this horizontal transfer belt 16.

Accordingly, when a coin is inserted into this rotary disc 14, first, at the lower portion of the rotary disc 14, the coin is sent upwardly as it is supported by the inner wall of the hopper 31 and one of the pins 32, 32 and so on. Then, when the coin is scooped up to the vicinity of the upward position of the middle stage of the rotary disc 14, the coin is separated from the inner wall of the hopper 31, moves to the inner side of the rotary disc 14, comes into contact with the step portion 33 provided on this inner side, and is supported by the pin 32 and this step portion 33.

The coins thus scooped up upwardly one by one are separated gradually from the pin 32 in the vicinity of the upper portion of the rotary disc 14 by their own weight and are transferred onto the guide 15 extending into the rotary disc 14. The coin thus transferred onto the guide 15 is transfered horizontally over the guide 15 as it is squeezed between pins 36, 36 and so on of the aforementioned horizontal conveyor belt 16.

At this juncture, the pins 32, 32 and so on of the rotary disc 14 pass through the escape groove 34 of the guide 15, which facilitates the transference of the coins.

It should be noted that, the mechanism of transfer between the rotary disc 6 provided in the vicinity of the opening 2 on the one hand, and the following received coin transfer passage on the other, can be constructed in a manner substantially similar to the transfer mechanism shown in FIG. 2. This transfer mechanism can be constructed by the hopper 31, the notches 35, 35 and so on, and the guide 15 inclined and provided with the escape groove 34.

Next, description will be made hereinafter of the mechanism linking the horizontal transfer passage and the coin storing tubes 19 with reference to FIGS. 3 and 4.

Figure 3:
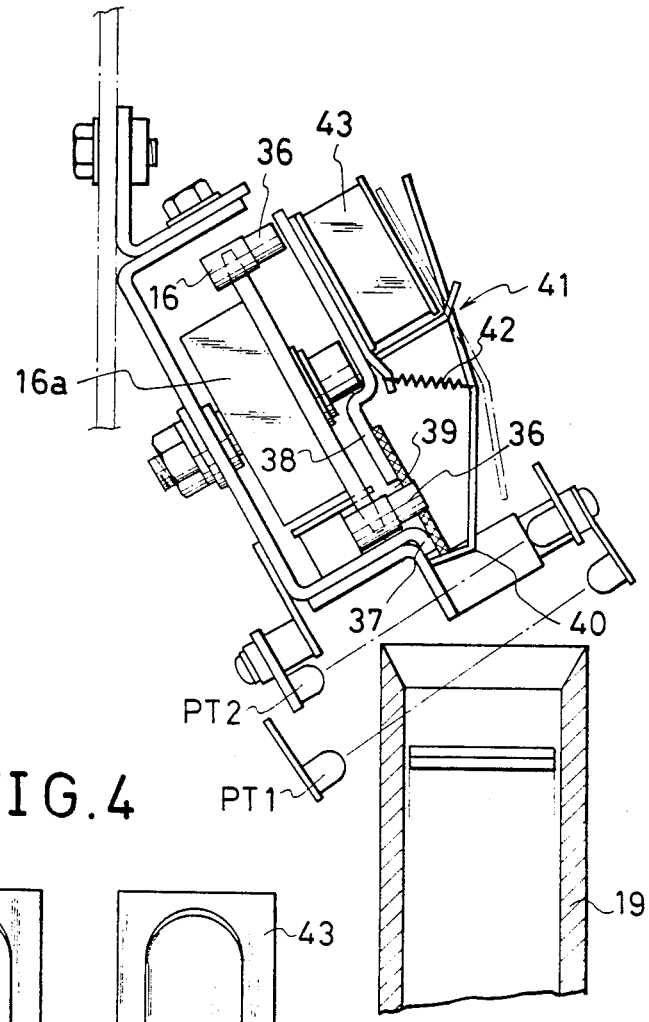
FIG. 3 is a cross-sectional view showing a horizontal transfer passage.
Figure 4:
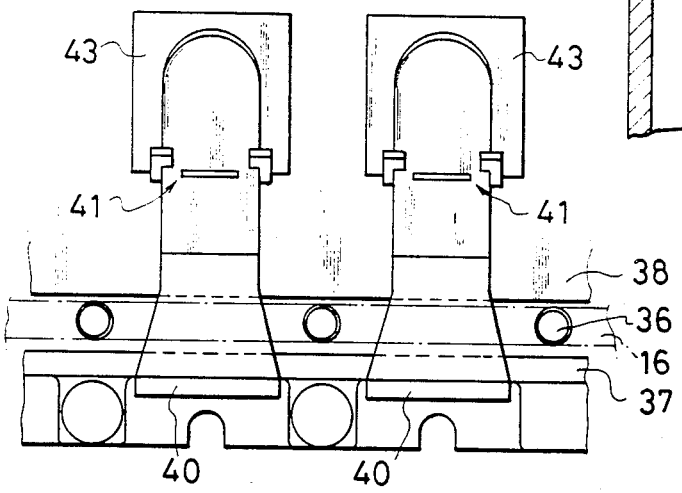
FIG. 4 is a front view showing the horizontal transfer passage.

FIG. 3 shows a cross sectional view of a horizontal transfer passage, and FIG. 4 is a partial front elevational view of the horizontal transfer passage.

In FIG. 3, the horizontal transfer passage is constituted by the following: a lower portion-supporting surface 37 for supporting the lower side portion of a coin; an upper portion-supporting surface 38 for supporting the upper side portion of the coin; a movement passage capable of guiding the pins 36, 36 and so on of the horizontal conveyor belt 16 for conveying the coin horizontally by engaging with the side portions of the coin between the lower portion- and upper-portion-supporting surfaces 37 and 38; and a lower end-supporting member for supporting the lower end of the coin.

The lower end-supporting member is constituted by the following: the guide 15 extending to the tip of the discriminator 17 along the horizontal transfer and passage; and gates 18*a*, 18*a* and so on of the gate mechanism 18 for distributing and storing the coins being conveyed to their corresponding coin storing tubes 19, 19 and so on, said gates 18*a*, 18*a* and so on being located at the tip of the guide 15.

To describe this gate mechanism 18 in detail with reference to FIG. 3, the gates 18*a*, 18*a* and so on are constituted by substantially L-shaped gate plates 40, 40 and so on shown in the drawing. These gate plates 40, 40 and so on are provided upwardly of each coin storing tube 19, 19 and so on, respectively.

The gate plate 40 (description will be given hereinafter with respect to one gate mechanism) is supported swingably with a supporting point 41 as its center, and is normally rotatably urged clockwise as viewed in FIG. 3 by means of a spring 42.

Accordingly, upon the actuation of a solenoid 43, the gate plate 40 rotates counterclockwise as viewed in FIG. 3 opposing the spring 42 with the supporting point 41 as its center, and causes the conveyed coin to fall into the coin storing tube 19 therebelow and to be stored therein.

Reference numeral PT1 in FIG. 3 indicates the photosensor of the aforementioned overflow detector 20, and reference numeral PT2 a dropping detecting sensor for detecting the dropping of the coin into the coin storing tube 19.

Next, description will be made of the pay-off mechanism 21 for paying off the coins.

As the pay-off mechanism for paying off coins, it is possible to use a conventionally known pay-off mechanism (e.g., a coin change machine, etc.), and one capable of paying off a desired number of stored coins one by one will suffice, said pay-out mechanism being generally constituted by a motor, or a solenoid, or a combination thereof.

Figure 5:
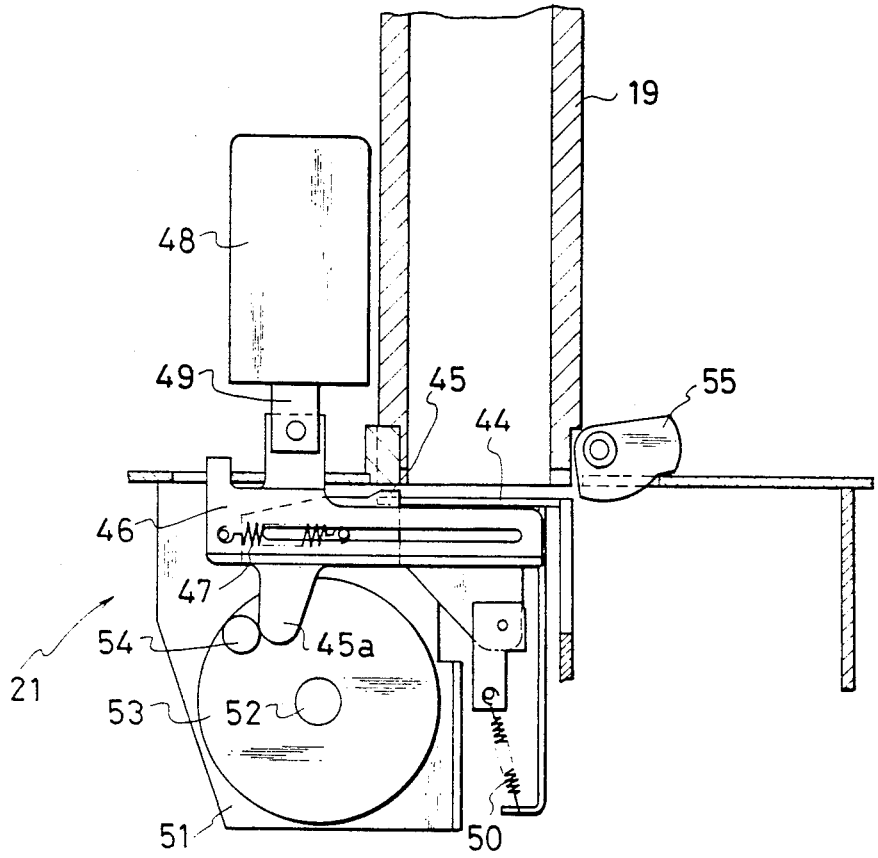
FIG. 5 is a partial cross-sectional view showing a pay-off mechanism.

FIG. 5 shows a partial cross sectional view of the pay-out mechanism 21 according to one embodiment of the present invention.

At the bottom portion of the coin storing tube 19, there is provided a bottom plate 44 for piling the coins to be stored.

This bottom plate 44 is split into two parts at its central portion to permit the reciprocating movement of a supporting member 46 and is urged leftwardly as viewed in the figure by means of a spring 47.

To the upper end of the supporting member 46, there is coupled the plunger 49 of a solenoid 48 for selecting a paying-out operation, and at the lower end thereof, a spring 50 is hooked so that the supporting member 46 is normally urged downwardly as viewed in the drawing (FIG. 5 shows a state in which, as the solenoid 48 for selecting a paying-out operation is actuated, the supporting member 46 is situated upwardly, and the tip of an extruding piece 45 projects from the upper surface of the bottom plate 44 of the coin storing tube 19.)

Meanwhile, downwardly of the supporting member 46, there is disposed a cam disc 53 provided to the rotary shaft 52 of a pay-out motor 51, and on this cam disc 53 is formed an actuator pin 54 capable of engaging with the engaging portion 45a of the aforementioned extruding piece 45.

Accordingly, as the rotary shaft 52 of the pay-out motor 51 rotates clockwise as viewed in FIG. 5, and the actuator pin 54 of the cam disc 53 is engaged with the engaging portion 45*a* of the extruding piece 45, the extruding piece 45 moves rightwardly as viewed in FIG. 5 within the supporting member 46. Furthermore, as the rotary shaft 52 rotates, and the engagement between the actuator pin 54 of the cam disc 53 and the engaging portion 45*a* of the extruding piece 45 is released, the extruding piece 45 is caused to move leftwardly as viewed in FIG. 5 within the supporting member 46 by means of the spring 47 and returns to the state shown in FIG. 5.

If the solenoid 48 for selecting a paying-out operation is actuated while the extruding piece 45 is moving rightwardly as viewed in FIG. 5, the end portion of the extruding piece 45 projects from the upper surface of the bottom plate 44 of the coin storing tube 19, the coins being stored in the coin storing tube 19 are paid off onto the lift belt 22 beginning with the lowermost coin.

Reference numeral 55 in FIG. 5 indicates a detection plate which is actuated by the coin paid off from the coin storing tube, and paying off can be confirmed as the pay-off detection sensor (shown in FIG. 6 which will be described later) PT3 is actuated by this detection plate 55.

Figure 6:
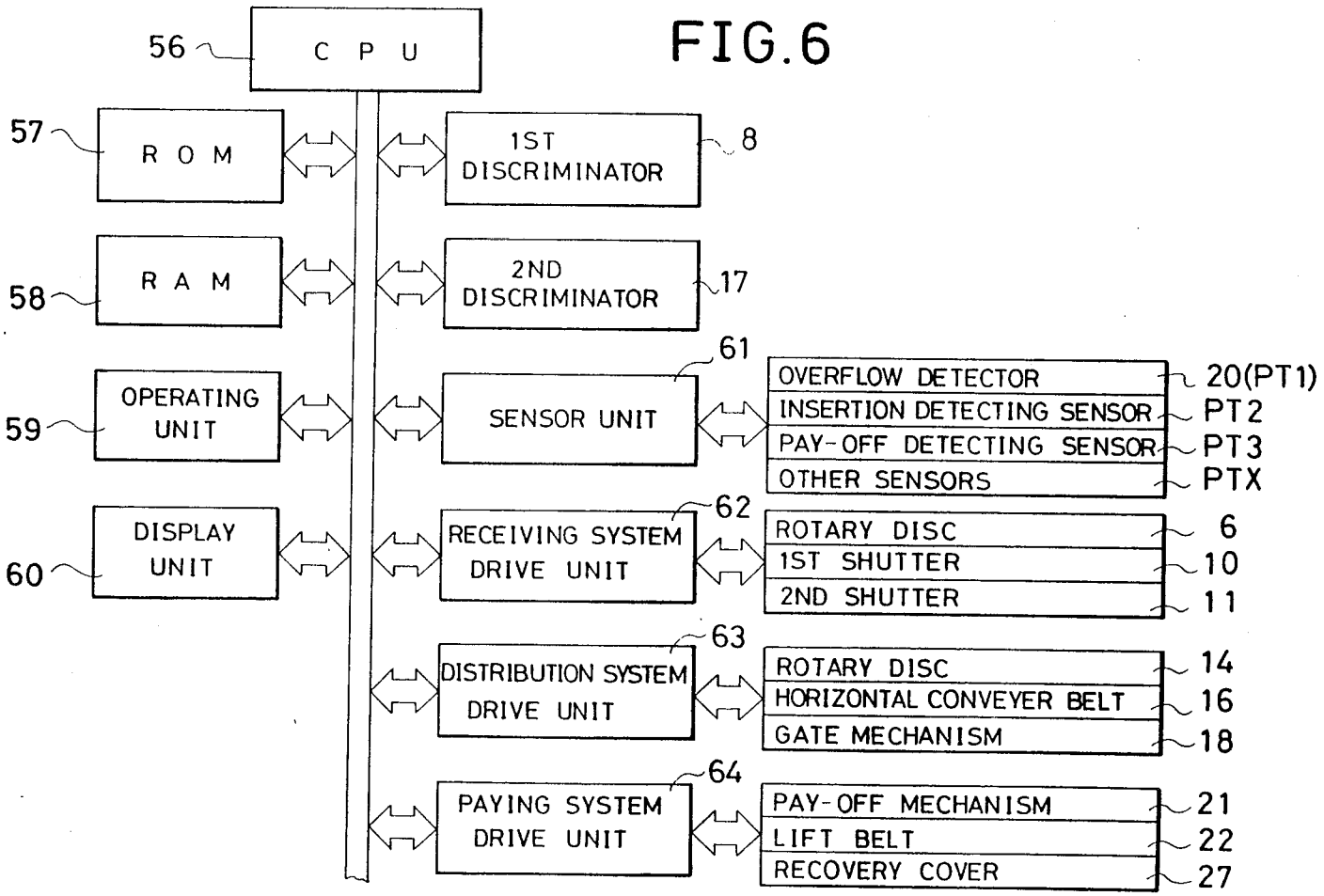
FIG. 6 is a block diagram illustrating a control mechanism for the machine.
Figure 7:
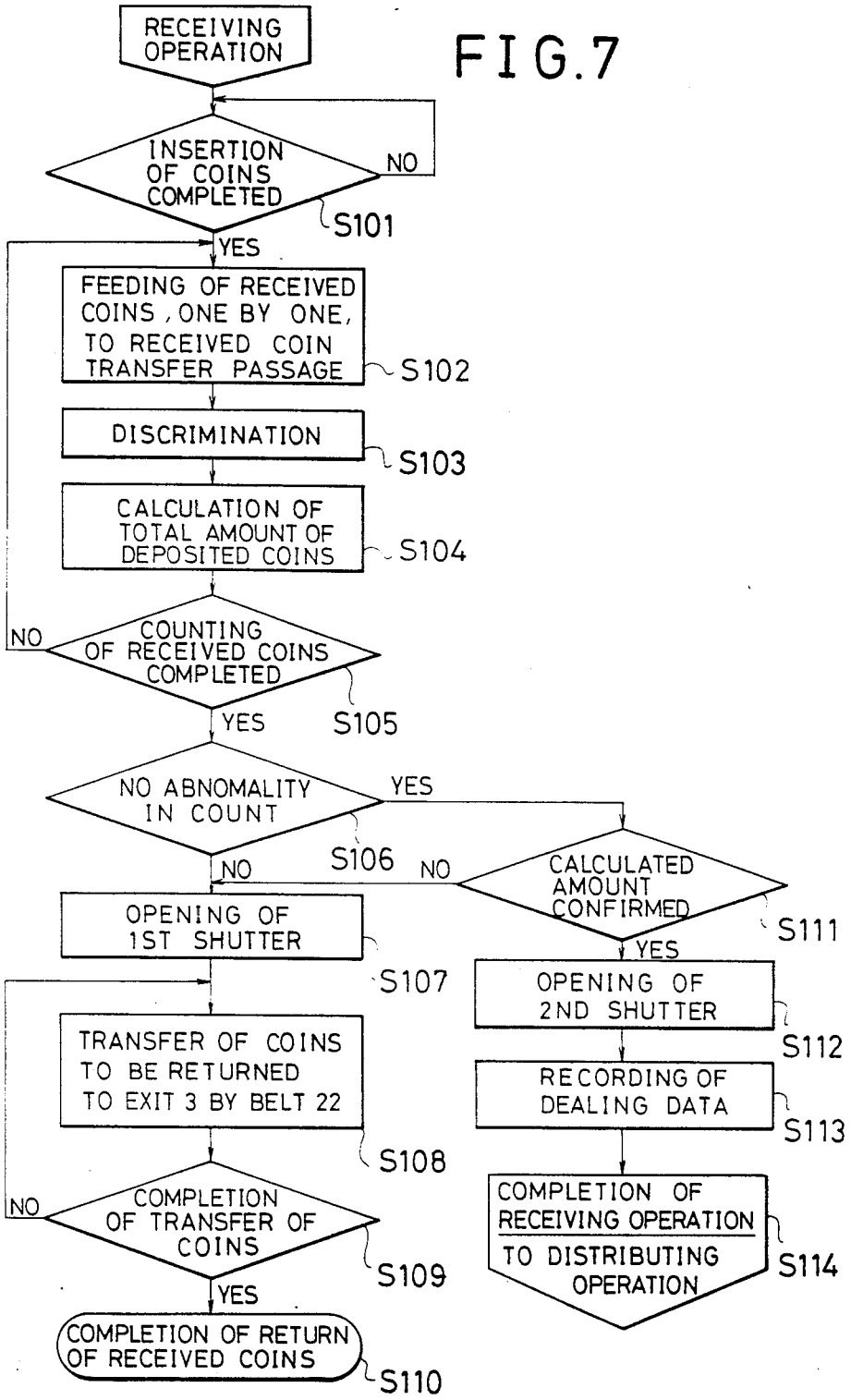
FIG. 7 is a flow chart showing a depositing operation of the machine.

FIG. 6 is a block diagram illustrating the control mechanism of the automatic coin depositing and paying machine having the construction thus far described. FIG. 7 is a flow chart showing each operational procedure controlled in accordance with the block diagram shown in FIG. 6.

In FIG. 6, reference numeral 56 indicates a CPU for controlling each operational procedure in accordance with a flow chart to be described later. Connected to this CPU 56 are the following: a ROM 57 in which the aforementioned operational procedures are stored; a RAM 58 in which various information is recorded or erased in accordance with the aforementioned operational procedures; an operating unit 59 for inputting various data in accordance with the aforementioned operational procedures; a display unit 60 for displaying various data in accordance with operational procedures; a sensor unit 61 into which is input information of various sensors (for instance, the overflow detector 20, insertion detecting sensor PT2, pay-off detecting sensor PT3, and other sensors PTX) provided in the automatic coin depositing and paying machine; a receiving system drive unit 62 for driving and controlling the rotary disc 6 and first and second shutters 10 and 11; a distribution system drive unit 63 for driving and controlling the rotary disc 14, horizontal conveyor belt 16, and gate mechanism 18 in accordance with the aforementioned operational procedures; a paying system drive unit 64 for driving and controlling the pay-off mechanism 21, lift belt 22, and recovery cover 27; the first discriminator 8 operating at the time of a depositing operation to be described later; and the second discriminator 17 operating at the time of a distributing operation to be described later.

Each operational procedure will be described hereinafter with respect to the automatic coin depositing and paying machine having the construction thus far described, with reference to the flow charts shown in FIGS. 7 to 10.

First, description will be made of cases where a coin is deposited.

FIG. 7 shows a flow chart at the time of depositing.

(Step 101)

If a depositing operation is selected, judgment is made as to whether or not the insertion of a coin is completed. In the case of YES, the operation proceeds to Step 102, and, in the case of NO, the operation remains on stand-by in this condition.

At this juncture, a coin is inserted into the opening 2 as indicated by an arrow (a) in FIG. 1, and a switch (not shown) or the like for indicating the completion of insertion is operated.

(Step 102)

Upon confirmation of the insertion of the coin, the rotary disc 6 rotates in the direction of an arrow (b), and the coins are fed to the received coin transfer passage one by one.

(Step 103)

The coins on the received coin transfer passage 7 are sent in the direction shown by an arrow (c), their diameters and materials are discriminated by the first discriminator 8, and the coins are temporarily stored in the vertical cylinder 9, as shown by an arrow (d).

(Step 104)

The total amount of received coins temporarily stored in the vertical cylinder 9 is calculated, and, at the same time, the total amount of coins deposited is displayed.

(Step 105)

Judgment is made as to whether or not all the coins inserted through the opening 2 have been discriminated and counted, and, in the case of YES, the operation proceeds to Step 106, while, in the case of NO, the operation returns to Step 102 so that the discrimination and counting of the deposited coins can continue.

(Step 106)

Judgment is made as to whether or not there were any abnormalities during the discrimination and calculation of the deposited coins, and, in the case of NO (there are abnormalities), the operation proceeds to Step 107, and, in the case of YES (there are no abnormalities), the operation proceeds to Step 111.

(Step 107)

In a case where it is detected in Step 6 that even a single improper coin is mixed among the deposited coins, the first shutter 10 is opened up to the position of a two-dotted line shown by an arrow (e), and all the deposited coins are dropped on the lift belt 22 via the first chute 12 as returned coins, as shown in an arrow (f).

(Step 108)

The returned coins dropped on the lift belt 22 are conveyed on the lift belt 22 as shown by arrows (g) and (h) and are returned to the opening 3 via the drop hole 23.

(Step 109)

Judgment is made as to whether or not all the coins to be returned have been returned and conveyed to the exit 3, and, in the case of YES, the operation proceeds to Step 110, and, in the case of NO, the operation returns to Step 108 to continue the returning and conveying operation.

(Step 110)

This completes the received coin returning operation.

In a case where the deposited coins are returned as described above, the abnormal coin(s) among them are checked, and such operations as redepositing are effected.

(Step 111)

Furthermore, in a case where it is detected in Step 106 that all the deposited coins are proper, confirmation of the total amount of the deposited coins displayed in Step 104 is carried out by the operator. When the confirmation of the displayed amount is made (YES), the operation proceeds to Step 112, and when the displayed amount is questionable and confirmation cannot be made as a result (NO), the operation proceeds to Step 107 to effect a received coin returning operation.

(Step 112)

In a case that all the deposited coins are proper and confirmation of the total amount of the deposit displayed is made, the second shutter is opened up to the position of the two-dotted line shown by an arrow (j), and the deposited coins are caused to drop onto the rotary disc 14 via the slip slope as received coins.

(Step 113)

The data on dealings such as the total amount of deposited coins are recorded.

(Step 114)

The depositing operation is completed, and the operation proceeds to a distributing operation.

Next, description will be made of a case where received coins are distributed to the coin storing tubes 19, 19 and so on as payable coins.

Figure 8:
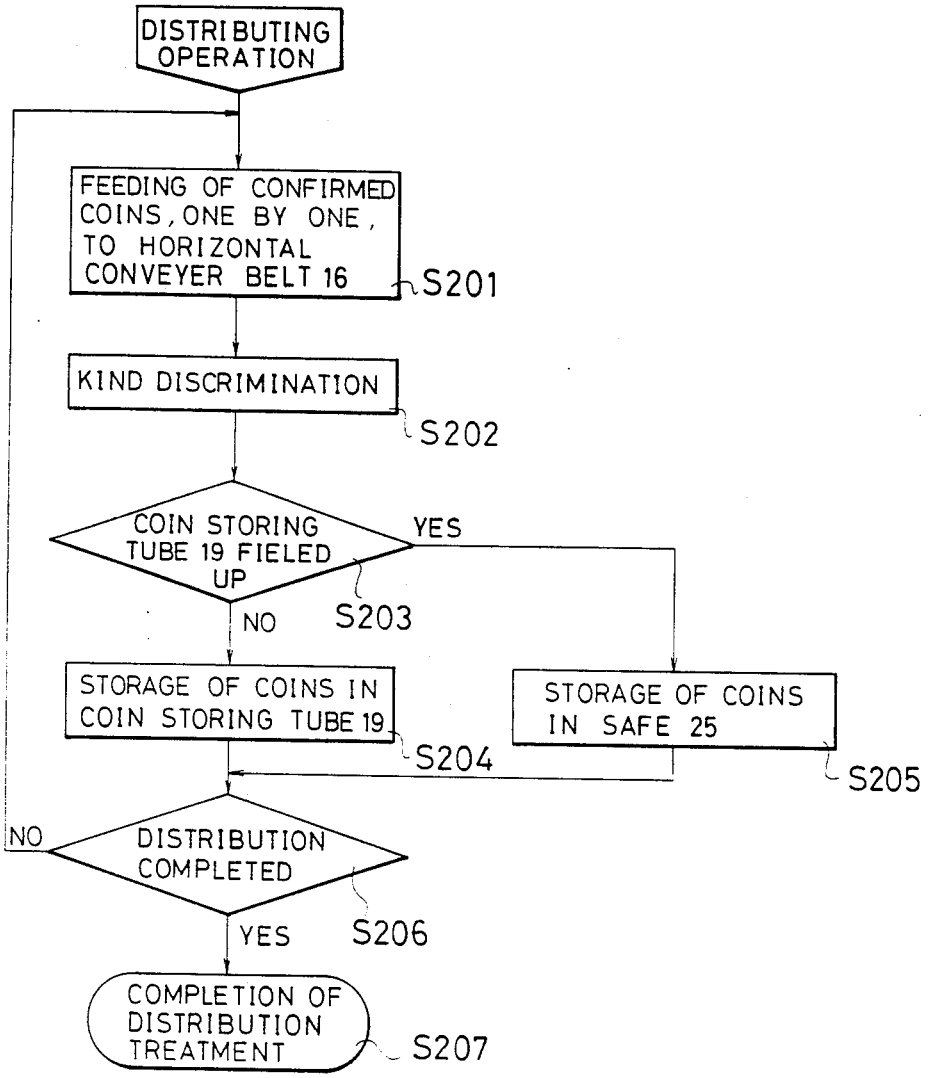
FIG. 8 is a flow chart showing a distributing operation of the machine.

FIG. 8 shows a flow chart at the time of distribution.

(Step 201)

Upon the completion of the coin-receiving operation, the operation of distributing received coins is automatically effected.

In other words, as the rotary disc 14 rotates in the direction of an arrow (k), the rotary disc 14 scoops up the coins one by one onto the guide 15, feeding the coins between the pins 36, 36 and so on of the horizontal conveyor belt 16, as described before.

(Step 202)

Then, during the initial period when the coins are conveyed horizontally in the direction of an arrow (l), the kinds of coins are discriminated by the second discriminator 17.

(Step 203)

The condition, with respect to whether or not it is filled up, of the coin storing tube 19 in which are stored coins whose kinds have been discriminated in Step 202 is judged by means of the photosensor PT1 of the overflow detector 20. In the case of NO (not filled up), the operation proceeds to Step 204, and, in the case of YES (filled up), the operation proceeds to Step 205.

(Step 204)

After the kinds of coins have been discriminated and when it is detected that the coin storing tubes 19 of the corresponding kinds of coins are not filled up, the gate plate 40 of the corresponding coin type is rotated, as shown by a two-dotted line in FIG. 3, and the coins are caused to drop and pile up in the coin storing tube where they are then stored as shown by an arrow (m) in FIG. 1. Then, the operation proceeds to Step 206.

In this case, since the distance from the second discriminator 17 to the coin storing tubes 19, 19 and so on of the respective coin types is known in advance, as is the conveying speed of the horizontal conveyor belt 16, the coins can be stored positively in the coin storing tubes 19 of the respective coin types by monitoring the volume (time) of conveyance at the time when the types of coins are discriminated.

In addition, the time of opening the gate plate 40 at that time is also determined by the width of the gate plate 40 and the conveying speed of the horizontal conveyor belt 16.

(Step 205)

After the discrimination of the coin type, if it is detected that the coin storing tube 19 corresponding to the coin type is filled up, the gate plate 40 of the corresponding coin type is not operated, and the coins of that coin type are conveyed to the end of the horizontal transfer passage, sent to the second chute 24 as shown by an arrow (n), are caused to drop into the safe 25, and stored as proper coins.

(Step 206)

Judgment is made as to whether or not all the received coins deposited in the rotary disc 14 have been distributed to and stored in the coin storing tubes 19, 19 and so on, or the safe 25. In the case of NO (distribution and storage incomplete), the operation returns to Step 201, and, in the case of YES (distribution and storage complete), the operation proceeds to Step 207.

(Step 207)

The distributing operation is completed.

Next, description will be made of a case where coins are paid out (payment is made).

Figure 9:
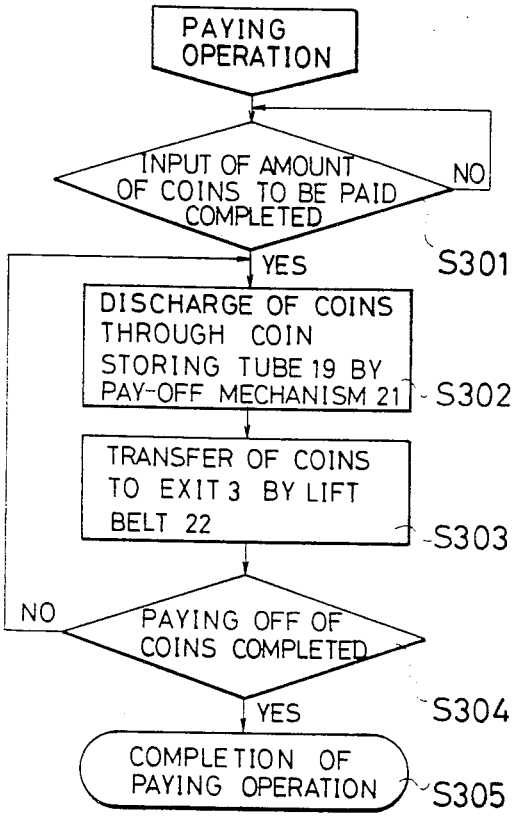
FIG. 9 is a flow chart showing a paying operation of the machine.

FIG. 9 shows a flow chart at the time of payment.

(Step 301)

Upon selection of the paying operation, judgment is made as to whether or not instructions as to such information as the types and the number of coins to be paid out have been completed. In the case of YES (the input of the amount to be paid, etc., is complete), the operation proceeds to Step 302, and, in the case of NO (the input is incomplete), the operation remains on stand-by at this Step 301.

(Step 302)

Upon completion of the input of the amount of payment, etc., the pay-off mechanism 21 delivers the set number of coins one by one from the coin storing tube 19 of the corresponding coin type, and drops them onto the lift belt 22 as shown by an arrow (p).

(Step 303)

The coins paid out onto the lift belt 22 are transferred by this lift belt 22 as shown by arrows (g), (h), and (l), and delivered into the carton 5 on the exit 4.

(Step 304)

Judgment is made as to whether or not the paying off of coins equivalent to the instructed amount has been completed. In the case of NO (the paying off of coins to be paid is incomplete), the operation returns to Step 302, and, in the case of YES (the paying off of coins to be paid is complete), the operation proceeds to Step 305.

(Step 305)

The paying operation is completed.

Finally, upon completion of dealings, all the coins inside the automatic coin depositing and paying machine are taken out of the machine body 1 and settlement is carried out. Description will be made of operations at the time of this settlement.

Figure 10:
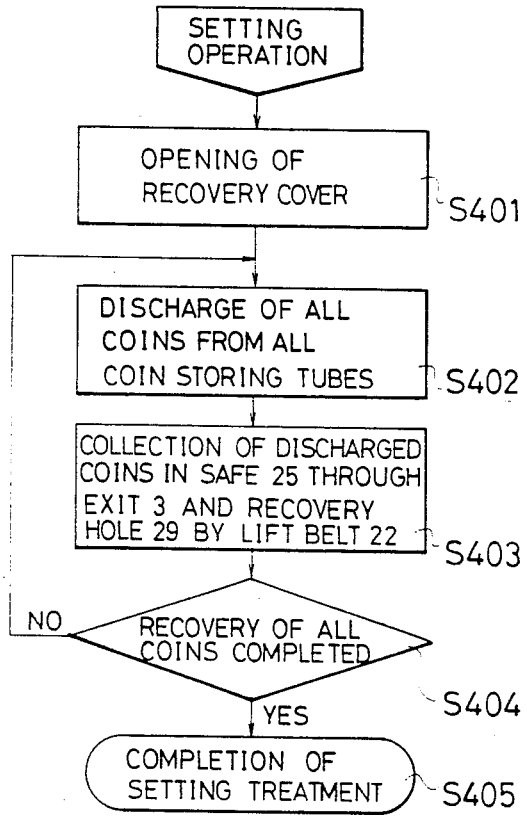
FIG. 10 is a flow chart showing a collecting operation of the machine.

FIG. 10 shows a flow chart at the time of settlement.

(Step 401)

First, the recovery cover 27 is caused to rotate by means of a motor or solenoid, as mentioned before, in the direction of an arrow (1) according to an instruction for settlement or the like, thereby opening the recovery hole 26.

(Step 402)

Then, all the coins stored in each coin storing tube 19, 19 and so on are delivered onto the lift belt 22 by means of the pay-off mechanism 21, as shown by an arrow (p).

(Step 403)

The coins thus delivered onto the lift belt 22 are conveyed by means of this lift belt 22 as shown by an arrow (g), and are caused to drop directly from the drop hole into the recovery hole as shown by an arrow (i).

At this juncture, the recovery cover 27 is located as shown by a two-dotted line in FIG. 27, and the coins are caused to drop into the recovery hole 26 while flying out of the coins is prevented. The coins are then guided by the recovery chute 28 and dropped into the safe 25 one by one, as shown by arrows (r) and (o), so as to be recovered and stored.

(Step 404)

Judgment is made as to whether or not the recovery of all the coins stored in each coin storing tube 19, 19 and so on is completed. In the case of NO (recovery incomplete), the operation returns to Step 402, and, in the case of YES (recovery complete), the operation proceeds to Step 405.

(Step 405)

The settlement operation is completed.

As is now apparent from the description thus far made, the present invention can enjoy the following excellent effects.

(1) Those of the coins inserted which are judged to be proper are reused so that most of the coins in circulation can be repeatedly used as payable ones. As a result, the amount of coins required for dealings can be reduced to enhance their circulating effect.

(2) The coins inserted are automatically stored as payable ones in the coin storing tubes so that their handling can be simplified without resorting to the aid of clerks.

(3) Since the coin storing tubes have functions to store both the inserted coins and the payable coins, the space for storing the coins can be reduced.

(4) All the coins can be recovered at the end of the dealings to facilitate their handling merely by dropping and collecting the coins which have been stored for paying purposes in the coin storing tubes from the machine exit through the recovery hole and by drawing the safe.

(5) The coin storing tubes need be neither extracted nor manually touched, so that their constructions can be simplified.

(6) As is apparent from the flow charts for the inserting, distributing and paying operations, since the distributing operation system and the inserting and paying operation system are made utterly independent, it is possible to effect the inserting operation and the paying operation at the same time even when the distributing operation of received coins is being carried out, and it is also possible to effect the distributing operation without interrupting the depositing and paying dealings.

Finally, in the embodiment of the present invention, in case there exists any indiscriminatable improper coin among the inserted coins, it is returned to the exit 3 together with the proper coins which are temporarily stored in the vertical cylinder 9. In view of the operability when discriminated coins and the improper coin or coins are detected, there may be disposed in the received coin transfer passage between the first discriminator 8 and the vertical cylinder 9 an undiscriminatable coin (rejection) mechanism (although not shown) which is enabled to (reject) an improper coin, each time it is discriminated, into the first chute 12 by way of a fourth chute (although not shown) thereby to instantly return the same to the exit 3. In this case, it is sufficient to issue commands only for the proper coins to be received or returned.

What is claimed is:

1. An automatic coin depositing and paying machine, said machine comprising:

a machine body;

an inlet opening defined by said body for receiving coins therethrough;

a first discriminator for discriminating the kinds and genuineness of coins received through said inlet;

storage means for temporarily storing all of the coins received in a single transaction after each of the coins have been discriminated by said first discriminator, said storage means including two shutters for dispensing coins after the coins have been temporarily stored;

a horizontal transfer passage for receiving genuine coins from said storage means through one of said two shutters;

a second discriminator disposed in the path of travel of coins on said horizontal transfer passage for discriminating the kinds of coins;

a plurality of coin storing tubes disposed below and along said horizontal transfer passage for respectively storing coins in accordance with the kinds of coins discriminated by the second discriminator;

a pay-off mechanism for paying off coins one by one from a lower portion of the coin storing tubes;

a lift belt for receiving coins paid out from the pay-off mechanism and for transferring the coins in an upward direction;

an exit defined by said body for receiving coins from the lift belt and for passing the coins through said exit;

a safe for receiving coins to be stored when at least one of the coin storing tubes is full of coins;

a recovery hole defined by said body providing a communication path between said safe and said exit; and a recovery cover mounted on said body for opening and closing said recovery hole, said recovery cover being closed to prevent passage of coins from entering said recovery hole (1) when coins are paid out by said pay-off mechanism and (2) when an improper coin is detected by said first discriminator.

2. A machine according to claim 1, wherein said lift belt receives coins directly from said storage means through the other of said two shutters.

3. A machine according to claim 2, wherein said one of said two shutters is opened when an improper coin is detected by said first discriminator, whereas said other of said two shutters is opened when all genuine coins are detected by said first discriminator.

4. A machine according to claim 1, further comprising an overflow detector disposed in an upper portion of the coin storing tubes for detecting if any of the coin storing tubes is filled with coins.

5. A machine according to claim 4, further comprising a chute connected to the horizontal transfer passage at the end thereof for guiding coins, and when the overflow detector detects that any of the coin storing tubes is filled with coins, the coins intended for the storing tube which is full are transferred by said chute to said safe.

* * * * *